US006895846B2

(12) United States Patent
Walker et al.

(10) Patent No.: US 6,895,846 B2
(45) Date of Patent: May 24, 2005

(54) SLICING MACHINE WITH TAPERED SLICING GATE

(75) Inventors: David B. Walker, Meridian, ID (US); Richard B. Jensen, Caldwell, ID (US); Ronald J. Plaisted, Caldwell, ID (US); Bruce T. Pittard, Caldwell, ID (US)

(73) Assignee: J.R. Simplot Company, Boise, ID (US)

( * ) Notice: Subject to any disclaimer, the term of this patent is extended or adjusted under 35 U.S.C. 154(b) by 42 days.

(21) Appl. No.: 10/691,011

(22) Filed: Oct. 21, 2003

(65) Prior Publication Data

US 2004/0079211 A1 Apr. 29, 2004

Related U.S. Application Data

(60) Provisional application No. 60/422,316, filed on Oct. 29, 2002.

(51) Int. Cl.[7] ..... B26D 3/24

(52) U.S. Cl. ..... 83/403; 83/408; 83/418; 83/932

(58) Field of Search ..... 83/404, 404.3, 83/408, 704, 705, 418, 932, 438–450

(56) References Cited

U.S. PATENT DOCUMENTS 2,436,410 A * 2/1948 Urschel et al. ..... 83/403
3,472,297 A 10/1969 Urschel et al.
3,521,688 A 7/1970 Urschel et al.
3,857,310 A * 12/1974 Tiby ..... 83/403
4,206,671 A * 6/1980 Hoehn ..... 83/408
4,625,606 A * 12/1986 Pinegar et al. ..... 83/403
5,249,494 A * 10/1993 Borvitz ..... 83/403
6,561,067 B2 * 5/2003 Arrasmith ..... 83/408
2002/0144584 A1 * 10/2002 Arrasmith et al. ..... 83/663

* cited by examiner

*Primary Examiner*—Stephen Choi
(74) *Attorney, Agent, or Firm*—Kelly Lowry & Kelley, LLP

(57) ABSTRACT

A slicing machine includes a tapered slicing gate for use in cutting products such as potatoes or the like into a plurality of slices each having a tapered thickness. The slicing machine generally corresponds to U.S. Pat. No. 3,521,688 and includes a rotary impeller for carrying the products by centrifugal force against an interior surface of a nonrotating cylindrical outer impeller housing, a portion of which defines an adjustable slicing gate forming a cutting slot of controlled thickness relative to a stationary slicing knife for cutting the products into the plurality of slices. A tapered ramp is formed or mounted at a downstream end of the slicing gate so that the cutting slot and the resultant slices have a tapered configuration. The tapered slices may be cut further into elongated strips, such as French fry potato strips, having a tapered lengthwise thickness.

18 Claims, 6 Drawing Sheets

SLICING MACHINE WITH TAPERED SLICING GATE

This application claims the benefit of U.S. Provisional Application No. 60/422,316, filed Oct. 29, 2002.

BACKGROUND OF THE INVENTION

This invention relates generally to improvements in devices and methods for cutting food products such as vegetable products, and particularly such as potatoes, into a plurality of slices. More particularly, this invention relates to a relatively simple modification of a slicing machine to produce cut slices of adjustable tapered thickness.

Slicing machines are well known in the art for production cutting of food products such as potatoes and the like into a plurality of slices each having a predetermined slice thickness. Such machines have been further adapted for cutting the slices into elongated strips to form, for example, French fry potato strips having a predetermined and typically rectangular or square-cut cross sectional size and shape. In a typical production environment, the cut products are subjected to partial cooking as by parfrying and then frozen for facilitated storage and shipment to a foods facility such as a restaurant or supermarket or the like. The frozen cut products are subsequently finish prepared for eating by means of finish frying, oven heating, microwave heating and the like.

U.S. Pat. No. 3,521,688, which is incorporated by reference herein, shows and describes an exemplary slicing machine of the above described type. Products such as whole potatoes are conveyed into a rotary impeller within which the potatoes are thrown by centrifugal action into engagement with an outer, nonrotating and generally cylindrical impeller housing. A plurality of impeller paddles sweep the potatoes rotationally within the impeller housing into cutting engagement with a generally tangentially oriented slicing knife mounted at a downstream edge of a radially open cutting slot formed in the impeller housing. In this regard, an arcuate segment of the impeller housing adjacent opposite the slicing knife defines a slicing gate located at the upstream side of the cutting slot and having a downstream end that is selectively adjustable in a radial direction for variably increasing or decreasing the size or thickness of the cutting slot, thereby permitting variable selection of the thickness of each cut slice. U.S. Pat. No. 3,521,688 further shows and describes a rotatable knife drum mounted in close proximity to the cutting slot at the exterior of the impeller housing, wherein this knife drum carries a plurality of strip knives for cutting each potato slice into a plurality of elongated French fry strips.

The above described slicing machine is capable of handling a relatively large mass through-put of potatoes or other products in a production environment, with the resultant slices and resultant strips being characterized by a high degree of cut thickness uniformity. While uniformity of cut thickness is a desirable trait for many consumer products, such uniformity inherently connotes a machine-processed as opposed to a hand-cut product. For some products, an alternative and somewhat irregular cut configuration such as a tapered cut thickness characteristic of a hand-cut or home-made product is desirable.

The present invention relates to a modified slicing machine of the general type disclosed in U.S. Pat. No. 3,521,688, for production cutting of products such as potatoes and the like into a plurality of individual cut slices each having a tapered cross sectional thickness.

SUMMARY OF THE INVENTION

In accordance with the invention, a slicing machine is provided for cutting products such as food products, and particularly such as potatoes, into a plurality of cut slices, wherein the slicing machine includes a slicing gate having a tapered ramp in spaced relation with a slicing knife whereby the slices are cut with a tapered cross sectional thickness. These tapered cut slices may be further cut into elongated strips, such as French fry potato strips, each having a tapered thickness from one end to the other.

In a preferred form, the slicing machine generally corresponds to U.S. Pat. No. 3,521,688, which is incorporated by reference herein. The slicing machine includes a rotary impeller into which products such as whole potatoes are fed by suitable conveyor means. Within the impeller, the products are carried by centrifugal action against an interior surface of a nonrotating and generally cylindrical outer impeller housing, a portion of which defines the slicing gate cooperating with the slicing knife to form a cutting slot. A downstream end of the slicing gate is radially adjustable relative to the slicing knife for variably selecting the spacing therebetween, and thereby variably selecting and controlling the thickness relative of each cut slice.

The tapered ramp is carried by or mounted on the downstream end of the slicing gate. The tapered ramp, in the preferred form, has a generally L-shaped cross sectional shape defining a gate leg of tapered width forming an upstream side edge of the cutting slot with a tapered geometry, and a transition leg for smoothly guiding the radially outermost portion of each product such as a potato into cutting engagement with the slicing knife. The cut slice passes through the cutting slot and, in one preferred arrangement, into cutting engagement with strip knives mounted on a rotating knife drum for subdividing each cut slice of tapered thickness into a plurality of cut strips of tapered thickness. Adjustable setting of the radial position of the slicing gate adjustably varies the thickness of each tapered cut slice.

Other features and advantages of the invention will become more apparent from the following detailed description, taken in conjunction with the accompanying drawings which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENT

Figure 1:
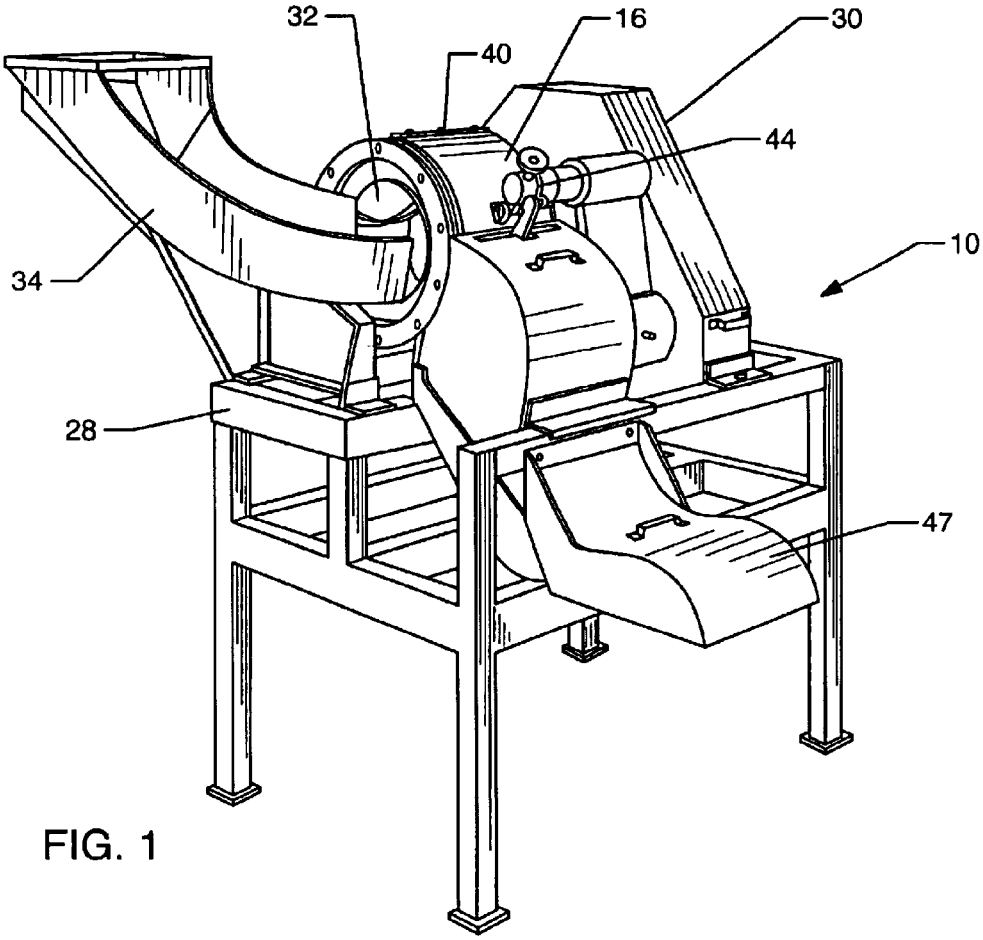
FIG. 1 is a perspective view illustrating a slicing machine of the general type shown in U.S. Pat. No. 3,521,688, and further including a tapered slicing gate in accordance with the present invention.
Figure 2:
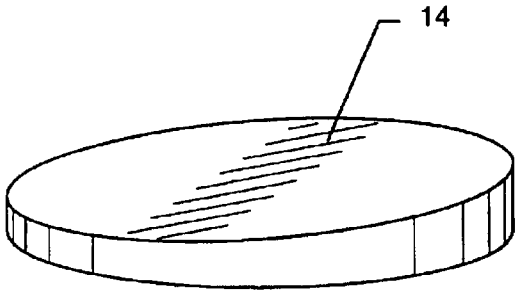
FIG. 2 is an enlarged perspective view illustrating a tapered food product slice, such as a potato slice, produced by the slicing machine of the present invention.
Figure 3:
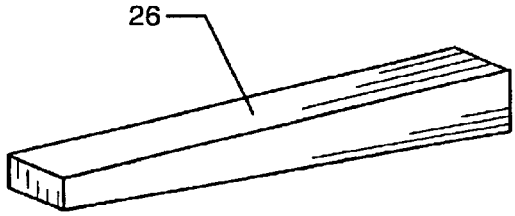
FIG. 3 is an enlarged perspective sectional view of a tapered food product strip, such as a French fry potato strip, produced by the slicing machine of the present invention.
Figure 4:
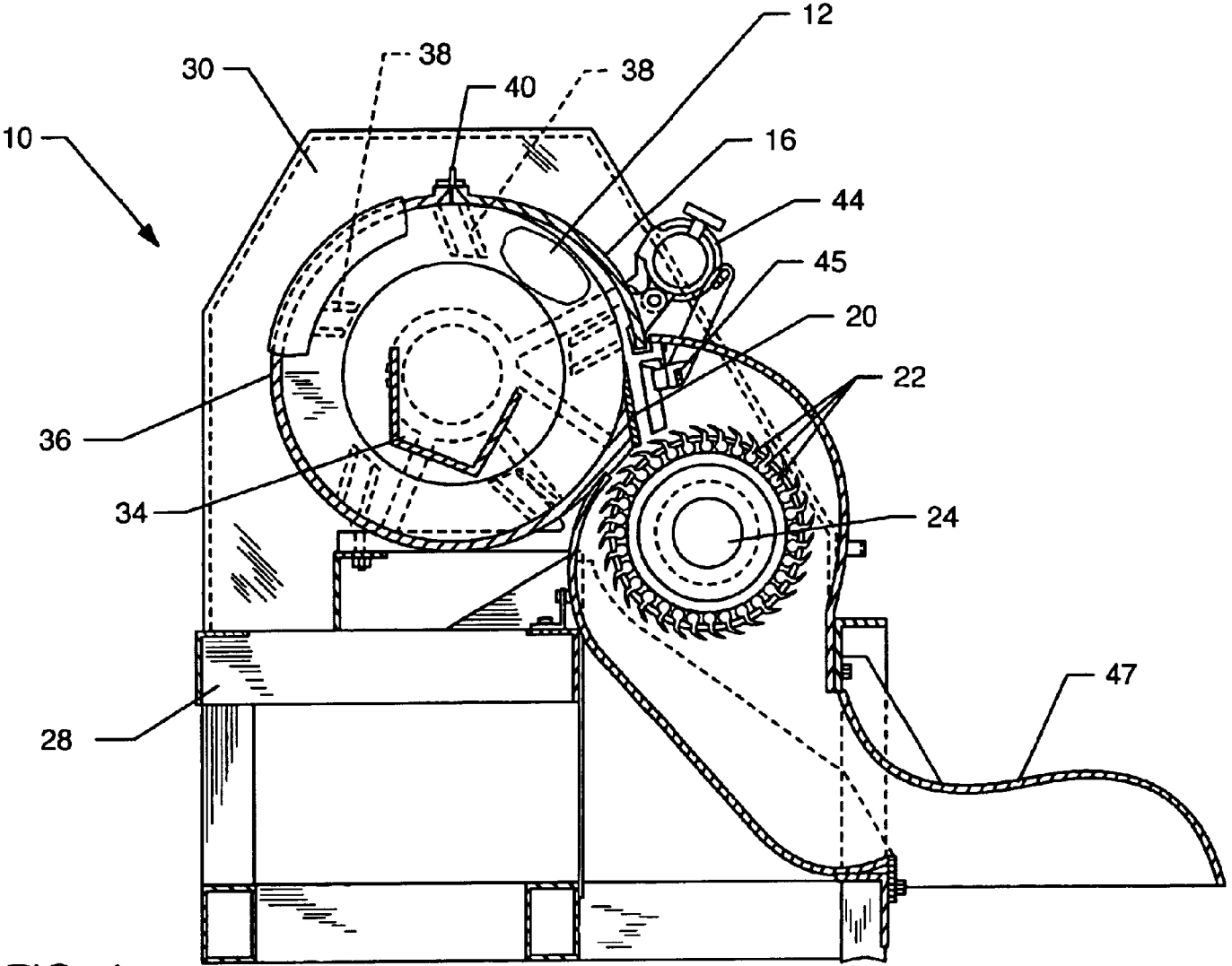
FIG. 4 is an enlarged and somewhat schematic side elevation view of the slicing machine of FIG. 1.
Figure 5:
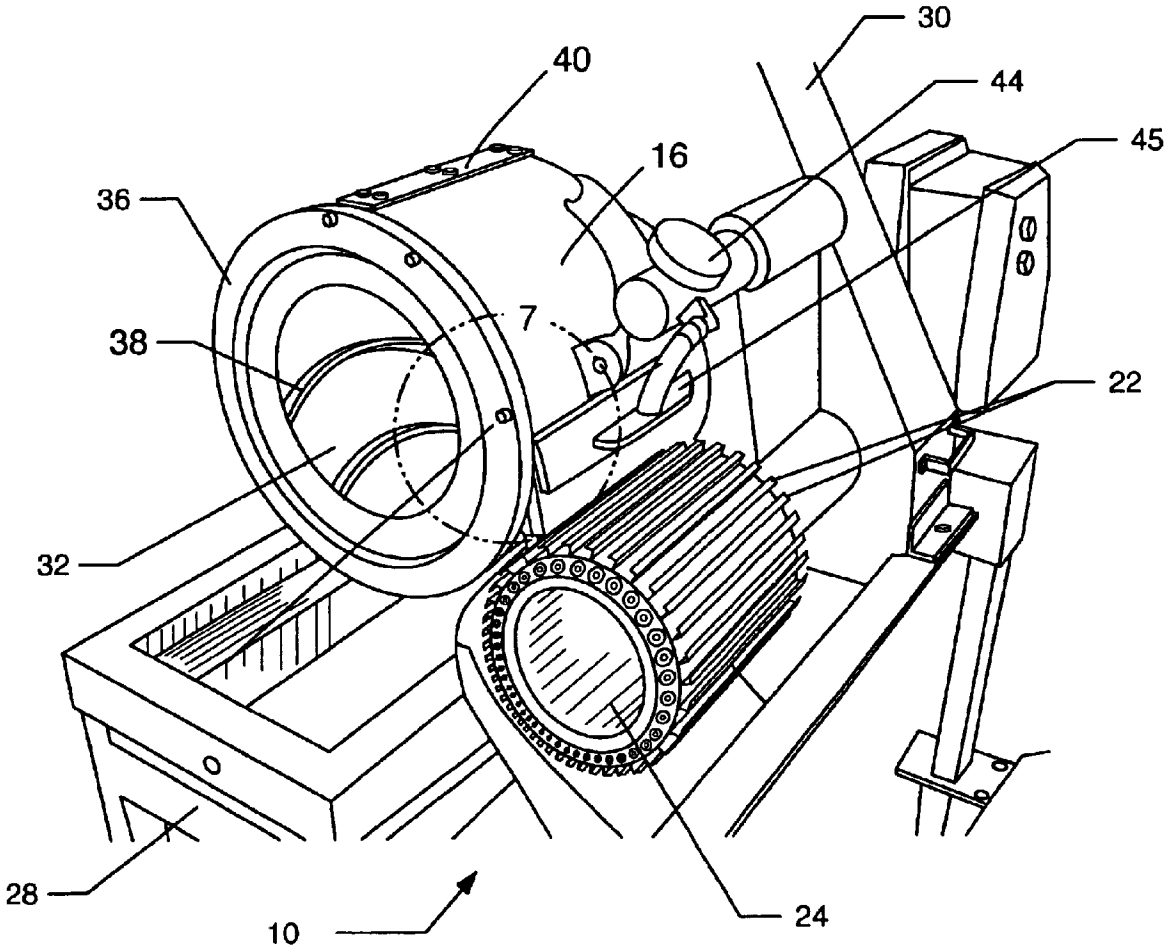
FIG. 5 is a fragmented side perspective view of a portion of the slicing machine, with portions thereof removed to illustrate internal components.
Figure 6:
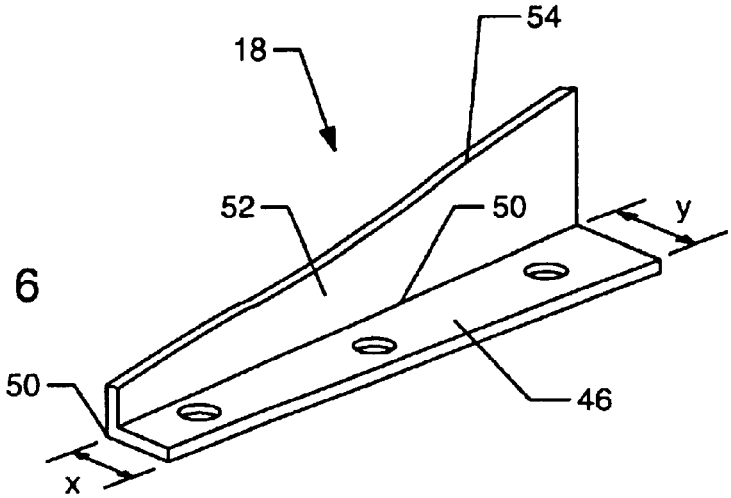
FIG. 6 is an enlarged perspective view of a tapered ramp for mounting onto the slicing gate of the slicing machine.
Figure 7:
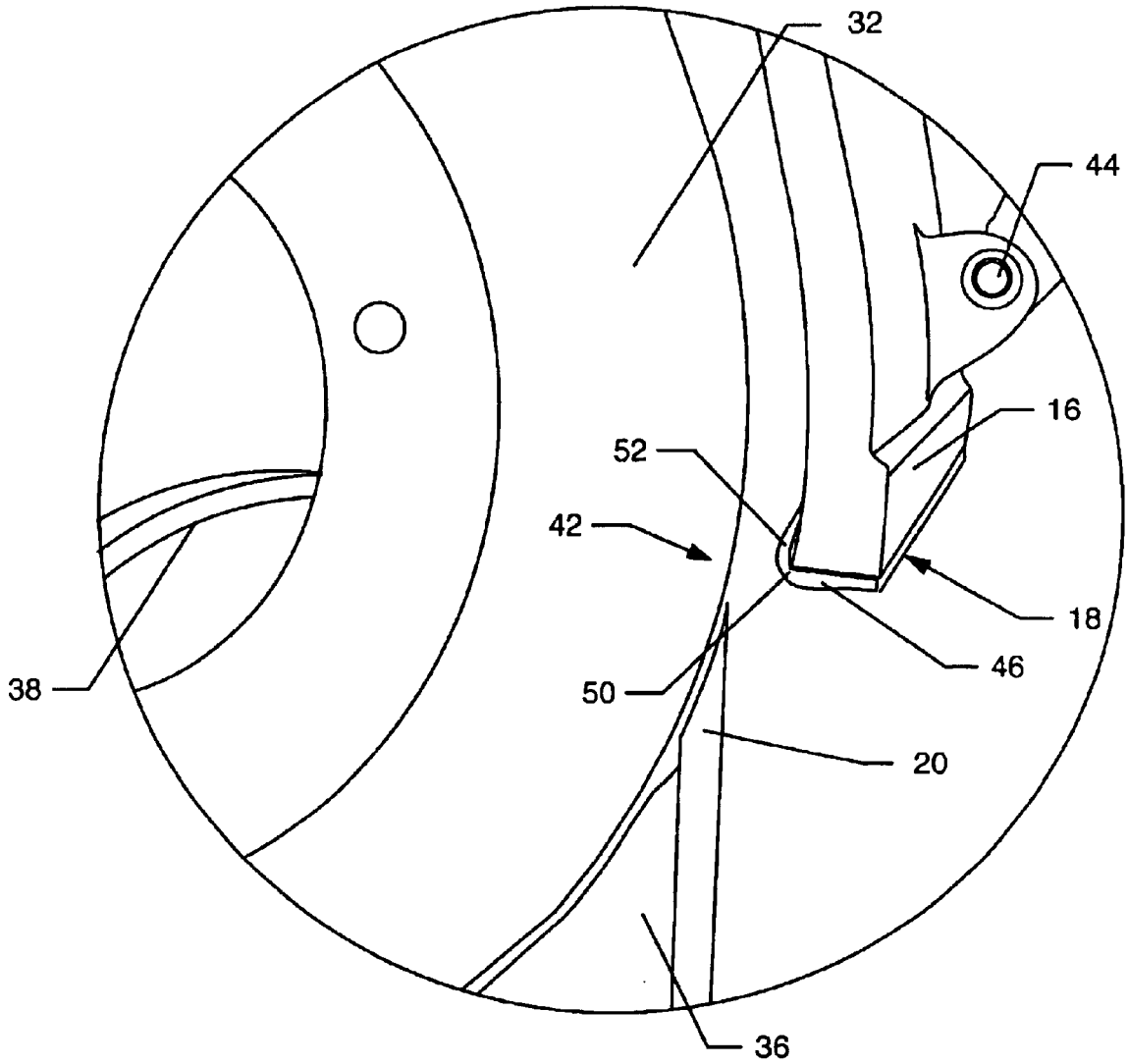
FIG. 7 is an enlarged fragmented perspective view corresponding generally with the encircled region 7 of FIG. 5.
Figure 8:
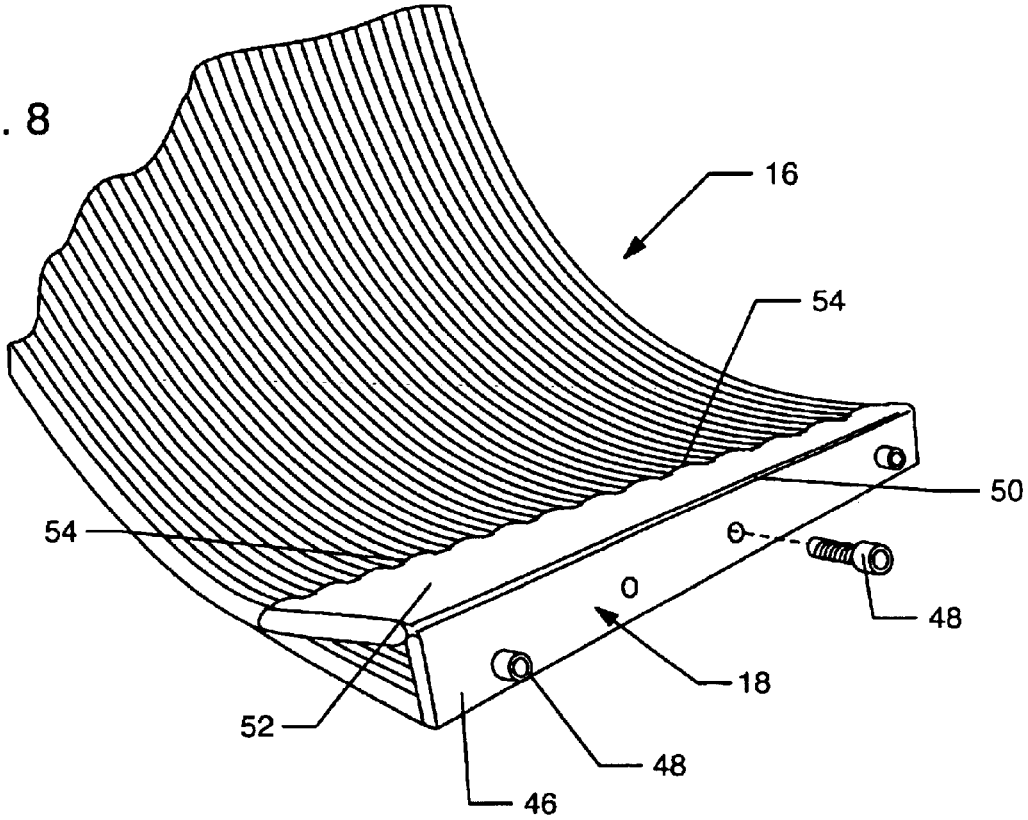
FIG. 8 is an enlarged fragmented inboard side perspective view of the slicing gate, and showing the tapered ramp mounted at a downstream end thereof.
Figure 9:
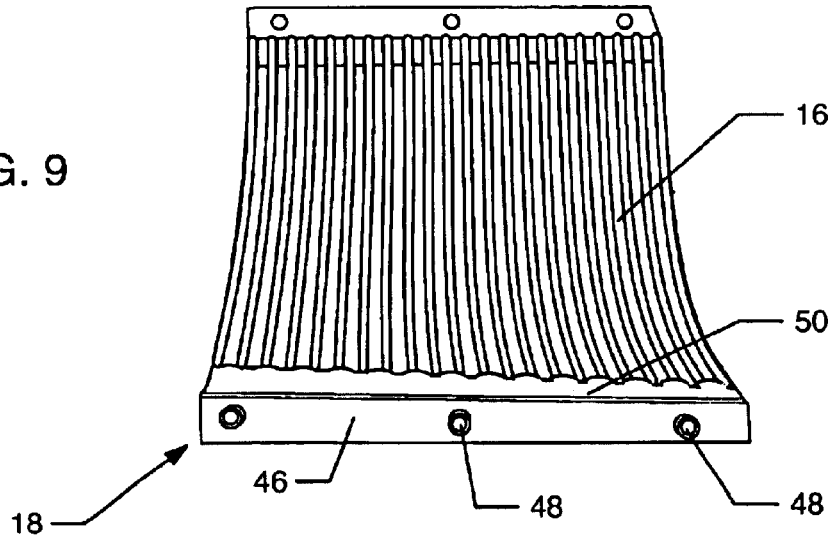
FIG. 9 is an enlarged downstream end elevation view of the slicing gate with the tapered ramp mounted thereon.

As shown in the exemplary drawings, a slicing machine referred to generally in FIGS. 1 and 4–5 by the reference numeral 10 is provided for cutting products such as vegetable products, and particularly such as potatoes 12 (FIG. 4) into a plurality of slices 14 (FIG. 2) of predetermined and tapered cross sectional thickness. The tapered geometry of each cut slice 14 is obtained by means of a slicing gate 16 (FIGS. 4–5 and 7–10) having a tapered ramp 18 for guiding each potato 12 into cutting engagement with a slicing knife 20. The illustrated slicing machine 10 may further include a plurality of strip knives 22 (FIGS. 4–5) carried on a rotary knife drum 24 for further cutting of the tapered slices into a plurality of elongated strips 26 (FIG. 3) each having a tapered cross sectional thickness from one end to the other.

The illustrated slicing machine 10 may be constructed generally in accordance with the slicing machine shown and described in U.S. Pat. No. 3,521,688. As shown, this slicing machine 10 comprises a machine frame 28 having a suitable drive motor (not shown) and related transmission (also not shown) mounted within a protective cowling 30. This drive motor and transmission are adapted for synchronized rotatable driving of a rotary impeller 32 and the rotary knife drum 24 at appropriate relative or proportional speeds, as will be described in more detail. In general, the rotary impeller 32 carries the products such as potatoes 12 into cutting engagement with the slicing knife 20 to cut each potato into a plurality of slices 14 of selected thickness, whereas the strip knives 22 carried on the rotary drum 24 function to cut each slice 14 into a plurality of elongated strips 26 such as French fry potato strips. The distance between the blades on the rotary drum 24 (FIG. 4) could be varied to produce a variety of cut sizes with the desired taper.

Figure 10:
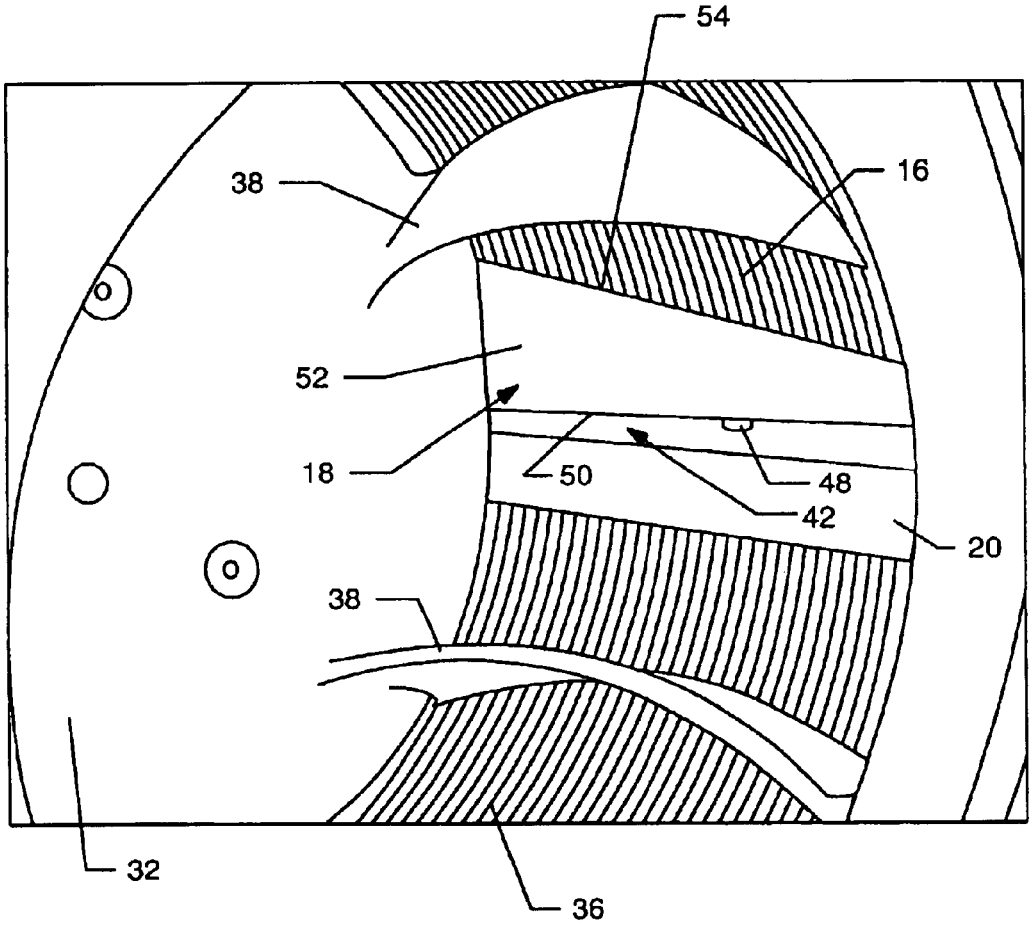
FIG. 10 is an enlarged perspective view illustrating the inboard side of the slicing gate with tapered ramp mounted thereon, in assembled relation with a rotary impeller of the slicing machine.

The products such as potatoes 12 are fed or conveyed to the rotary impeller 32 by conveyor means, shown in the exemplary drawings (FIGS. 1 and 4) to include a slide chute 34 for guiding potatoes typically in single file at an appropriate mass flow rate to the impeller 32. The rotary impeller 32 comprises an open-sided ring structure mounted for rotational displacement about a generally horizontal axis, within an open-sided and generally cylindrical, nonrotating outer impeller housing 36. The potatoes or the like are fed by the chute 34 into the open side of the impeller housing 36 and rotatable impeller 32 therein. These potatoes fall into contact with an interior wall surface of the impeller housing 36 where they are picked and swept rotationally within the housing by a circumferentially arranged array of impeller paddles 38 (FIGS. 4 and 10). As is known in the art, the impeller 32 and the paddles 38 thereof rotate within the housing 36 at a speed sufficient to carry and maintain each potato 12 in sliding engagement with the interior wall of the housing, by means of centrifugal force.

An arcuate portion of the impeller housing 36 defines the slicing gate 16. In this regard, FIGS. 1 and 4 show the slicing gate 16 to have an arcuate span of about 90°, extending from an upstream end (relative to the direction of impeller rotation) pivotally connected to the remainder of the impeller housing by means of a suitable hinge 40 or the like. A downstream end of the slicing gate 16 terminates in a spaced relation to the slicing knife 20 mounted in a stationary manner onto the impeller housing 36 in an axially extending orientation. Thus, the slicing knife 20 and the downstream end of the slicing gate 16 cooperatively define therebetween a cutting slot 42. The downstream end of the slicing gate 16 may be radially adjusted in position for increasing or decreasing the precise spacing relative to the slicing knife 20, in accordance with the setting of an adjustment mechanism 44, for controllably varying and selecting the thickness of each slice 14 to be cut.

In operation, the rotary impeller 32 by means of the paddles 38 thereof sweeps the products 12 rotationally along the interior wall surface of the impeller housing 36 and further along an interior wall surface of the adjustably set slicing gate 16, to carry each product into cutting engagement with the slicing knife 20. The resultant cut slice 14 passes through the cutting slot 42 to the exterior of the impeller housing 36 for subsequent cutting, if desired, by the peripherally mounted strip knives 24 on the rotary knife drum 22 to produce elongated French fry strips 26 or the like. A guide unit 45 (FIGS. 4 and 5) is provided for smoothly guiding the cut slices 14 into engagement with the strips knives 24. The rotary strip drum 22 is driven at an appropriate speed relative to rotation of the impeller 32 to result in cut strips 26 of desired cross sectional size. Such cut strips 26 are normally delivered from the rotary knife drum 22 through a suitable discharge conduit 47 (FIG. 4) to conveyor means (not shown) leading to subsequent processing equipment. The remaining uncut portion of each product within the impeller 32 continues to be rotated within the impeller to carry the product through another revolution back into cutting engagement with the slicing knife 20 for cutting another slice 14.

The foregoing general construction and operation of the slicing machine 10 corresponds to and is described in more detail in U.S. Pat. No. 3,521,688, which is incorporated by reference herein.

In accordance with the present invention, the tapered ramp 18 is included at the downstream end of the slicing gate 16, so that each cut slice 14 has a desired tapered cross sectional thickness. This tapered ramp 18 comprises, in one preferred form, a separate element adapted for relatively quick and easy mounting onto the downstream end of the slicing gate. However, persons skilled in the art will recognize and appreciate that the tapered ramp may be formed as an integral portion of the slicing gate.

As shown best in FIGS. 6–10, the illustrative tapered ramp 18 has a generally L-shaped cross section defining a gate leg 46 having a tapered width from one end to the other. This gate leg 46 is configured for mounting onto the downstream end of the slicing gate 16 in a position overlying said downstream end, by means of a plurality of screws 48 or the like. As shown, the gate leg 46 has a tapered inboard edge 50 extending from a relatively narrow end dimension "X" (FIG. 6) at one end to a comparatively wider end dimension "Y" (FIG. 6) at an opposite end. In one preferred geometry, the narrow dimension "X" corresponds generally with the radial thickness of the downstream end of the slicing gate 16 (shown best in FIG. 7), so that the inboard edge 50 of the gate leg 46 protrudes radially inwardly from the slicing gate downstream end by a progressively increasing increment from the narrow end "X" to the wider end "Y". With this configuration, the tapered inboard edge 50 of the gate leg 46 effectively defines a tapered structure at the upstream end of the cutting slot 42.

The inboard edge 50 of the gate leg 46 is joined to a transition or ramp leg 52 extending generally circumferentially and in an upstream direction at the inboard face of the slicing gate 16. This ramp leg 52 is angularly set relative to the gate leg 46, and has a tapered free edge 54, terminating in substantially flush contact surface engagement with the interior surface of the slicing gate 16. In operation, this ramp leg 52 smoothly guides and transitions each product 12 for smooth sliding passage over the tapered inboard edge 50 of the gate leg 46, and further into cutting engagement with the slicing knife 20. As a result, one surface of each cut slice 14 is defined by the axially extending position of the slicing knife 20, whereas the opposite surface of the cut slice is oriented according to the tapered angle of the gate leg edge 50. Since the gate leg edge 50 is angularly oriented relative to the slicing knife 20, the resultant cut slices 14 have a tapered cross sectional thickness which, upon subsequent cutting of the slices into strips, yields elongated strips having a similar tapered cut cross sectional thickness.

The overall thickness of each cut slice 14 can be adjustably varied by appropriate setting of the adjustment mechanism, whereas the particular taper angle can be chosen according to the configuration of the tapered ramp 18. Alternative ramps 18 (not shown) may be provided with their respective gate leg edges 50 set at different angular or tapered configurations, with a selected ramp 18 being quickly and easily mounted onto the slicing gate 16 to produce the desired cut products.

A variety of modifications and improvements in and to the slicing machine 10 of the present invention will be apparent to those persons skilled in the art. Accordingly, no limitation on the invention is intended by way of the foregoing description and accompanying drawings, except as set forth in the appended claims.

What is claimed is:

1. In a rotary slicing machine having an impeller rotatably driven within a generally cylindrical impeller housing to carry food products by centrifugal force into sliding contact with an interior surface of said housing, said impeller housing having at least one radially open cutting slot cooperatively defined by a slicing gate at an upstream side thereof and a slicing knife at a downstream side thereof whereby the food products are carried by said impeller into cutting engagement with said slicing knife, the improvement comprising:

a tapered ramp at a downstream end of said slicing gate and defining a tapered edge forming said upstream side of said cutting slot, said tapered edge being angularly oriented relative to said slicing knife whereby the food products are cut into slices each having a tapered cross sectional thickness.

2. The improvement of claim 1 wherein said tapered ramp is mounted onto said downstream end of said slicing gate.

3. The improvement of claim 1 wherein said downstream end of said slicing gate is radially adjustable relative to said slicing knife for adjustably selecting slice thickness.

4. The improvement of claim 1 wherein said slicing gate comprising an arcuate segment hingedly connected to said impeller housing.

5. The improvement of claim 1 wherein said tapered ramp has a generally L-shaped cross sectional configuration including a gate leg having a tapered width and defining said tapered edge at said upstream side of the cutting slot, and a transition leg having a tapered free edge in substantially flush contact with an interior surface of said slicing gate, said transition leg guiding the food products smoothly over said tapered leg into cutting engagement with said slicing knife.

6. The improvement of claim 5 further including means for removably mounting said tapered ramp onto said slicing gate.

7. The improvement of claim 1 wherein said rotary impeller further includes at least one paddle for carrying the food products into sliding contact with said interior surface of said impeller housing.

8. The improvement of claim 1 wherein said rotary impeller comprises an open-sided ring structure rotatably driven on a generally horizontal axis.

9. The improvement of claim 1 wherein the food products comprise potatoes.

10. A rotary slicing machine, comprising:

a generally cylindrical impeller housing at least one radially open cutting slot cooperatively defined by a slicing gate at an upstream side thereof and a slicing knife at a downstream side thereof;

an impeller rotatably driven within said impeller housing for carrying food products by centrifugal action into sliding contact with an interior surface of said housing whereby the food products are carried by said impeller into cutting engagement with said slicing knife; and a tapered ramp at a downstream end of said slicing gate and defining a tapered edge forming said upstream side of said cutting slot, said tapered edge being angularly oriented relative to said slicing knife whereby the food products are cut into slices each having a tapered cross sectional thickness.

11. The rotary slicing machine of claim 10 wherein said tapered ramp is mounted onto said downstream end of said slicing gate.

12. The rotary slicing machine of claim 10 wherein said downstream end of said slicing gate is radially adjustable relative to said slicing knife for adjustably selecting slice thickness.

13. The rotary slicing machine of claim 10 wherein said slicing gate comprising an arcuate segment hingedly connected to said impeller housing.

14. The rotary slicing machine of claim 10 wherein said tapered ramp has a generally L-shaped cross sectional configuration including a gate leg having a tapered width and defining said tapered edge at said upstream side of the cutting slot, and a transition leg having a tapered free edge in substantially flush contact with an interior surface of said slicing gate, said transition leg guiding the food products smoothly over said tapered leg into cutting engagement with said slicing knife.

15. The rotary slicing machine of claim 14 further including means for removably mounting said tapered ramp onto said slicing gate.

16. The rotary slicing machine of claim 10 wherein said rotary impeller further includes at least one paddle for carrying the food products into sliding contact with said interior surface of said impeller housing.

17. The rotary slicing machine of claim 10 wherein said rotary impeller comprises an open-sided ring structure rotatably driven on a generally horizontal axis.

18. The rotary slicing machine of claim 10 wherein the food products comprise potatoes.

* * * * *